United States Patent [19]

Carl

[11] 4,070,880

[45] Jan. 31, 1978

[54] VEHICLE HOOD LOCK

[75] Inventor: Jack C. Carl, Tonawanda, N.Y.

[73] Assignee: McGard, Inc., Buffalo, N.Y.

[21] Appl. No.: 653,369

[22] Filed: Jan. 29, 1976

[51] Int. Cl.[2] ..... E05C 19/00

[52] U.S. Cl. ..... 70/240; 292/251

[58] Field of Search ..... 292/256, 258, 291, 251; 70/240; 85/45

[56] References Cited

U.S. PATENT DOCUMENTS

| | | | |
|---|---|---|---|
| 1,188,699 | 6/1916 | Strand | 292/291 |
| 1,434,411 | 11/1922 | Silverstein | 292/291 |
| 1,631,355 | 6/1927 | Boldwin | 292/258 X |
| 3,241,408 | 3/1966 | McCauley | 85/45 X |
| 3,415,086 | 12/1968 | Trainor | 70/240 |
| 3,668,908 | 6/1972 | Levy | 70/240 |

*Primary Examiner*—Richard E. Moore

*Attorney, Agent, or Firm*—Christel & Bean

[57] ABSTRACT

The present disclosure provides means for locking the engine compartment hoods of vehicles by a device which is detachably secured to the fixed vehicle body structure below a side edge of the hook and has a threaded upward extension which projects upwardly between the edge of the hood and the vehicle body structure. A nut engages the threads of the upward extension and overlies a side edge of the hood to prevent opening the hood. A specially keyed wrench is required to remove the nut and thus release the hood lock.

5 Claims, 6 Drawing Figures

VEHICLE HOOD LOCK

BACKGROUND OF THE INVENTION

This invention relates to locking devices for automotive engine compartment hoods or similar closures or access panels.

Since automotive hoods are not conventionally provided with individual locks the only arrangement for preventing unauthorized opening of such hoods is by locating the hood latch release within the passenger compartment of the vehicle. Since such passenger compartments are frequently left unlocked and are, in any event, easily entered by thieves even when locked, presently available means for preventing unauthorized access to the vehicle engine compartment is highly inadequate.

For the forgoing reasons it is very common for vehicle owners to find that their storage batteries have been stolen and in many cases other expensive engine accessories are lost in this manner.

SUMMARY OF THE INVENTION

The present invention provides a simple and effective locking device which may be applied to automotive engine compartment hoods and similar closures such as compartment doors and access panels without defacing the vehicle or requiring any drilling or other interference with the continuity of the vehicle body and hood structure. The locking device of the embodiment of the present invention illustrated and described herein by way of example is applicable to most automotive engine compartment hoods and similar closures.

The main body element of the locking device is removably attached to a portion of the body structure beneath the hood of the compartment and embodies a member which projects through the usual clearance crack between the fixed body structure and the hood itself, such projecting part being threaded to receive a special locking nut which can be released only by a special wrench which fits the locking nut.

DESCRIPTION OF THE ILLUSTRATED EMBODIMENT

Figure 1:
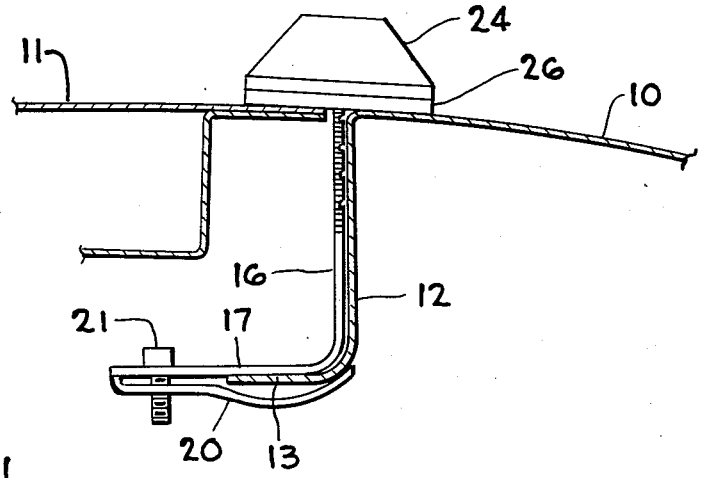
FIG. 1 is a transverse cross-sectional view through a vehicle body structure at the area where the side edge of the engine compartment hood meets the fixed body structure of the vehicle, usually the front fender, showing one form of the locking device of the present invention in position thereon.

In FIG. 1 the numeral 10 designates the portion of the front fender of a vehicle adjacent to the engine compartment and the numeral 11 designates a side edge portion of the hood which closes the engine compartment in the usual manner. In many vehicle body constructions the front fender 10 terminates at its inner edge in downwardly and inwardly extending flange formations designated by the numerals 12 and 13, respectively.

Figure 3:
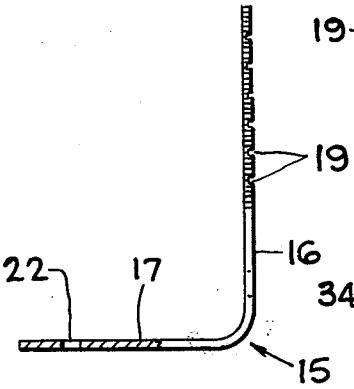
FIG. 3 is a elevational view of the principal body member of the locking device illustrated herein by way of example, viewed as in FIG. 1 and 2.
Figure 4:
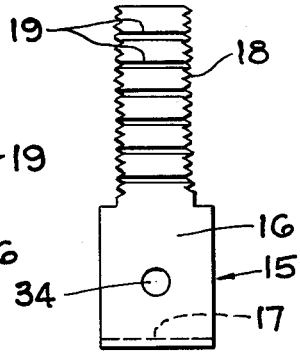
FIG. 4 is an elevational view of such body member taken at right angles to FIG. 3.
Figure 5:
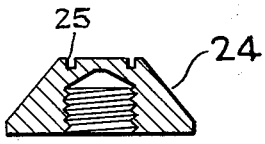
FIG. 5 is a vertical cross-sectional view through a locking nut employed in the present embodiment of the invention.
Figure 6:
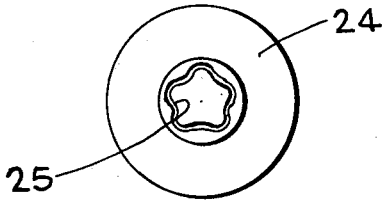
FIG. 6 is a top plan view of the locking nut of FIG. 5.

Referring particularly to FIGS. 3 and 4, the main body member of the present locking device comprises an angular member designated generally by the reference numeral 15 and comprising vertical and horizontal leg portions designated 16 and 17, respectively.

The vertical leg formation 16 of angle 15 is provided along its side edges with thread formations as at 18 and in one form of the invention the threaded portion is provided with a vertical series of horizontal grooves 19 which comprise weakened portions. It is thus readily possible to reduce the vertical extent of leg 16 to any desired degree by flexing the undesired upper end portion thereof back and forth with pliers to break off the leg at a desired groove 19 to establish the desired vertical height of leg 16.

In the form of the invention illustrated in FIG. 1 the angle member 15 has associated therewith a clamp 20 which cooperates with lower leg 17 of angle 15 to clamp the latter to the lower terminal flange 13 of the fender 10. A screw 21 passes through an opening 22 in lower leg 17 of angle number 15 and threads into clamp 20 to secure the angle number 15 to the lower terminal flange 13 of fender 10. In the illustrated instance the right hand end of clamp 20 is curved to engage about the juncture of flange 12 and 13 as shown in FIG. 1.

The nut which is applied to the upper end of the vertical leg 16 of member 15 for locking the hood against unauthorized access is designated 24 and is of the type shown and described in McCauley U.S. Pat. No. 3,241,408 dated Dec. 23, 1966.

Nut 24 is of generally frusto-conical form so that it cannot readily be gripped by pliers or a Stilson wrench. As in the aforementioned McCauley patent, the outer face of the nut is provided with a continuous irregular curvilinear groove or channel 25 which can be engaged only by a wrench having a complementary projection for fitting into groove 25. The groove 25 of various nuts 24 will vary in outline so that only the holder of the proper mating wrench will be able to manipulate nut 24.

A nylon or other nonmetallic washer 26 is preferably interposed between nut 24 and the vehicle body to avoid marring the fender or hood surfaces.

Figure 2:
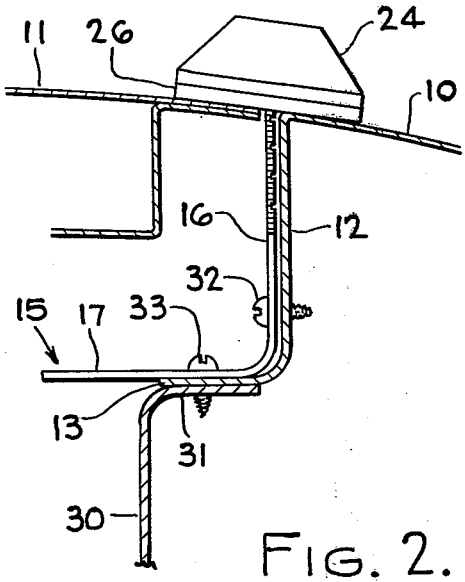
FIG. 2 is a view similar to FIG. 1 but showing the locking device thereof applied to a slightly different form of vehicle body structure.

The embodiment of the invention illustrated in FIG. 2 is very similar to that of FIG. 1 and accordingly like characters of reference have been applied to the various corresponding parts in FIG. 2. FIG. 2 illustrates the manner in which the present locking device may be applied to a vehicle body of slightly different construction.

In some vehicles a fire wall 30 has an upper flange 31 which is welded to the terminal flange 13 at the inner edge of fender 10. This prevents use of a clamp such as the clamp 20 of FIG. 1 and accordingly this clamp is omitted in the embodiment of FIG. 2 and the angle member 15 is attached to fender 10 by means of self-tapping screws 32 and 33. Screw 32 passes through an opening 34 in the vertical leg of angle member 15 and screw 33 passes through opening 22 in the lower leg of angle member 15. The embodiment of FIG. 2 is otherwise identical with that of FIG. 1.

A preferred embodiment of the present invention has been described herein and shown in the accompanying drawings to illustrate the underlying principles of the invention but it is to be understood that numerous modifications may be made without departing from the broad spirit and scope of the invention.

I claim:

1. In combination, a vehicular engine compartment hood and a body member adjacent thereto, a side edge of said hood extending along and generally flush with said body member, said body member having a recessed stop member for limiting closing movement of said hood, a hood locking device comprising a base portion secured to said stop member which underlies the hood when the latter is in closed position, said locking device having a member extending upwardly from said base between said hood and said fixed body member, said upwardly extending member having screw threads therealong, and a cap nut engageable with said threads with the hood in a closed position and overlying said hood to prevent opening movement thereof, said nut having keying formations in its outer face adapted to coact with a special wrench having complementary keying formations whereby said nut can be removed only by means of said special wrench.

2. A device according to claim 1 wherein said base and said upwardly extending member comprise an angle strap and wherein the base of said strap is detachably secureable to said body member.

3. A device according to claim 2 including a clamp plate associated with the base of said strap for detachably securing said angle strap to said body member.

4. A device according to claim 1 wherein said nut is of frusto-conical form and has keying formations in its outer face.

5. A device according to claim 4 wherein said keying formations comprise a continuous curvulinear channel.

* * * * *